US005398910A

United States Patent [19]

Kitazawa

[11] Patent Number: 5,398,910

[45] Date of Patent: Mar. 21, 1995

[54] DAMPER

[75] Inventor: Tomio Kitazawa, Nagano, Japan

[73] Assignee: Kabushiki Kaisha Sankyo Seiki Seisakusho, Nagano, Japan

[21] Appl. No.: 126,396

[22] Filed: Sep. 24, 1993

[30] Foreign Application Priority Data

Sep. 28, 1992 [JP] Japan ..... 4-282512

[51] Int. Cl.[6] ..... F16K 1/20; F16K 31/04

[52] U.S. Cl. ..... 251/129.11; 251/250; 251/299

[58] Field of Search ..... 251/129.11, 250, 299

[56] References Cited

U.S. PATENT DOCUMENTS

| | | | |
|---|---|---|---|
| 2,629,629 | 2/1953 | Etnyre | 251/250 X |
| 4,526,342 | 7/1985 | Wakefield | 251/129.11 X |
| 4,642,998 | 2/1987 | Kang et al. . | |
| 4,836,497 | 6/1989 | Beeson | 251/250 X |

FOREIGN PATENT DOCUMENTS

| | | |
|---|---|---|
| 3713764 | 4/1987 | Germany . |
| 3603851 | 8/1987 | Germany . |
| 3997476 | 9/1990 | Germany . |
| 6357877 | 4/1988 | Japan . |
| 206418 | 3/1982 | Netherlands . |

*Primary Examiner*—Arnold Rosenthal
*Attorney, Agent, or Firm*—Sughrue, Mion, Zinn, Macpeak & Seas

[57] ABSTRACT

A damper including a motor, a reduction gear train rotatably coupled with the motor, reducing rotation of the motor and transmitting the reduced rotation of the motor to a baffle, a rack meshing with a last-stage gear of the reduction gear train and engaged with the baffle at an eccentric position relative to a pivot of the baffle, and the baffle receiving reciprocation of the rack at the eccentric position relative to the pivot of the baffle and pivoting about the pivot of said baffle so as to open and close.

3 Claims, 2 Drawing Sheets

DAMPER

BACKGROUND OF THE INVENTION

The invention relates to an improvement of a drive section of a damper that controls the operation of opening and closing a cold air inlet by a baffle within a refrigerator.

As shown in Japanese Utility Model Unexamined Publication No. Sho. 63-57877, a conventional damper is designed to open and close a baffle in the following way. The rotational force of a motor is reduced by a reduction gear train, and such reduced force is transmitted to a projecting end-face cam that is formed on one side surface of a gear of the reduction gear train. Under such conditions, the baffle is opened and closed by a spindle that moves vertically relative to the end face of a gear formed on the end-face cam, the spindle which is in slidable contact with the end-face cam. The opening and closing operation of the baffle is performed in the form of a turning movement about the pivot of the baffle; more specifically, the opening operation is performed by the spindle driven by the end-face cam, and the closing operation is performed by turning the baffle with the biasing force of a plate spring applied in the closing direction.

The conventional damper results in the following problems.

(1) The opening and closing dimensions (that is, the opening and closing stroke) of the baffle are restricted by a shape of the cam.

(2) A force for closing the baffle consists of only the elastic force which is caused by the plate spring, therefore the baffle is liable to stop when the baffle is frozen.

(3) The amount of projection of the cam is increased-when the opening stroke is set to a large value. This means that the cam must be thick in the axial direction and thereby increases the entire structure of the damper.

SUMMARY OF THE INVENTION

An object of the invention is to overcome the above-mentioned problems associated with the cam mechanism by using a mechanical structure in place of the cam mechanism as a means for transmitting the rotational force of the motor to the opening and closing movement of the baffle.

To achieve the object, the present invention provides a damper including a motor, a reduction gear train rotatably coupled with the motor, reducing rotation of the motor and transmitting the reduced rotation of the motor to a baffle, a rack meshing with a last-stage gear of the reduction gear train and engaged with the baffle at an eccentric position relative to a pivot of the baffle, and the baffle receiving reciprocation of the rack at the eccentric position relative to the pivot of the baffle and pivoting about the pivot of said baffle so as to open and close.

DETAILED DESCRIPTION OF THE PREFERRED EMBODIMENTS

Figure 2:
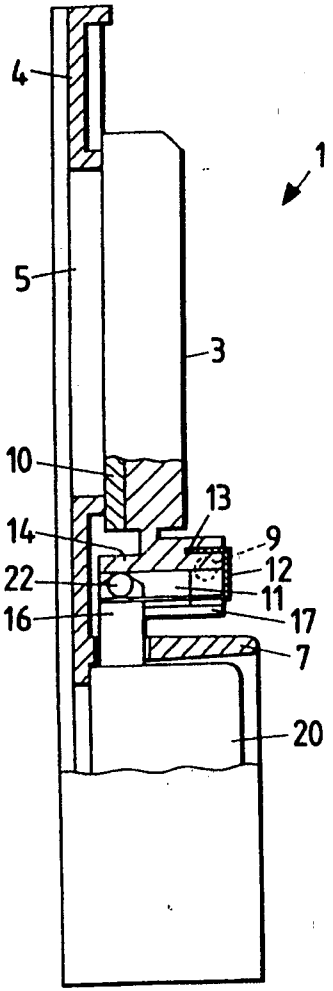
FIG. 2 is a partially cutaway side view of the damper.

FIGS. 1 to 5 show a damper 1 according to the present invention, which is designed to control the opening and closing of a cold air inlet by a baffle inside a refrigerator. This damper 1 includes a motor 2 serving as a drive source and a baffle 3 driven by the motor 2 in opening and closing directions. These components are mounted on the front end side of a frame 4.

The frame 4 is a plate-like plastic molded product. A cold air inlet 5 is arranged at a slightly upper middle position of the frame 4. Both right and left sides below the cold air inlet 5 have two bearings 6. At least one of holding strips 8, which holds the motor 2 at a partition plate 7 below these bearing as a boundary, is formed integrally with the frame 4.

Figure 1:
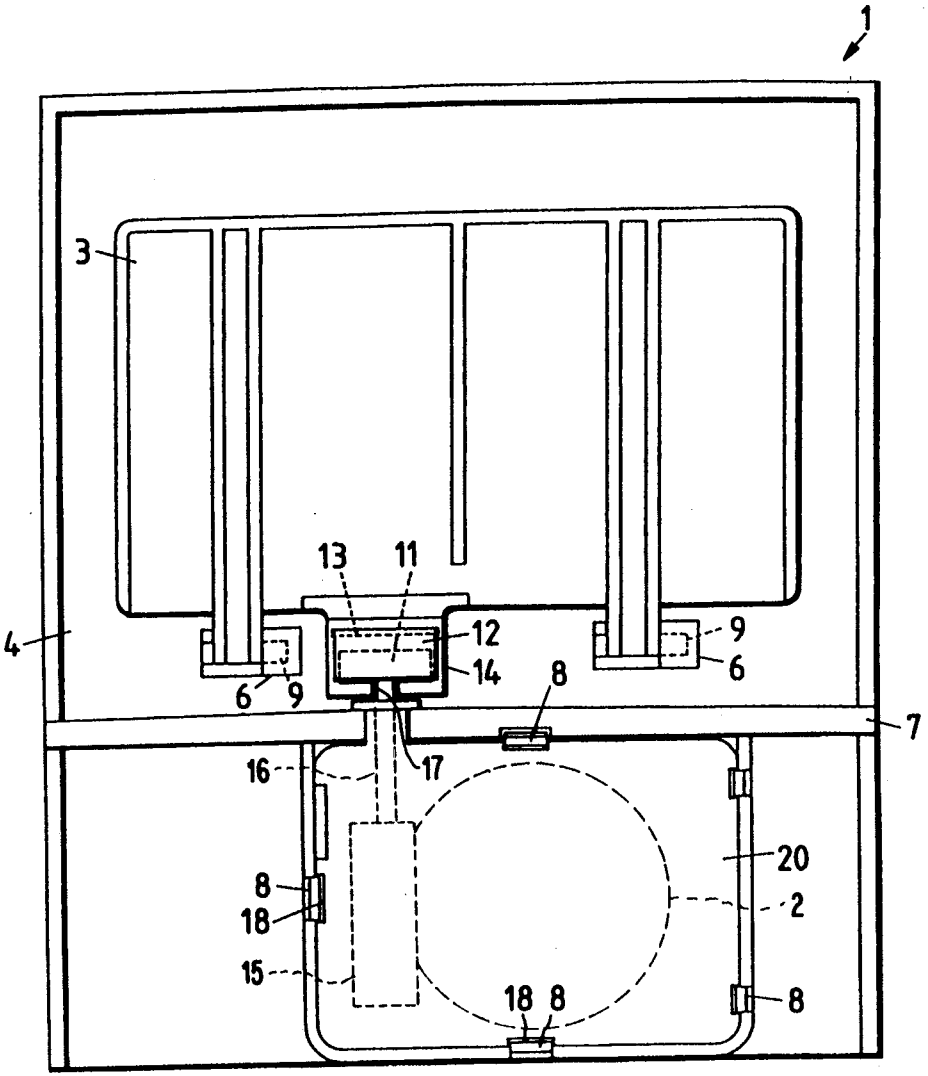
FIG. 1 is a front view of a damper.
Figure 3:
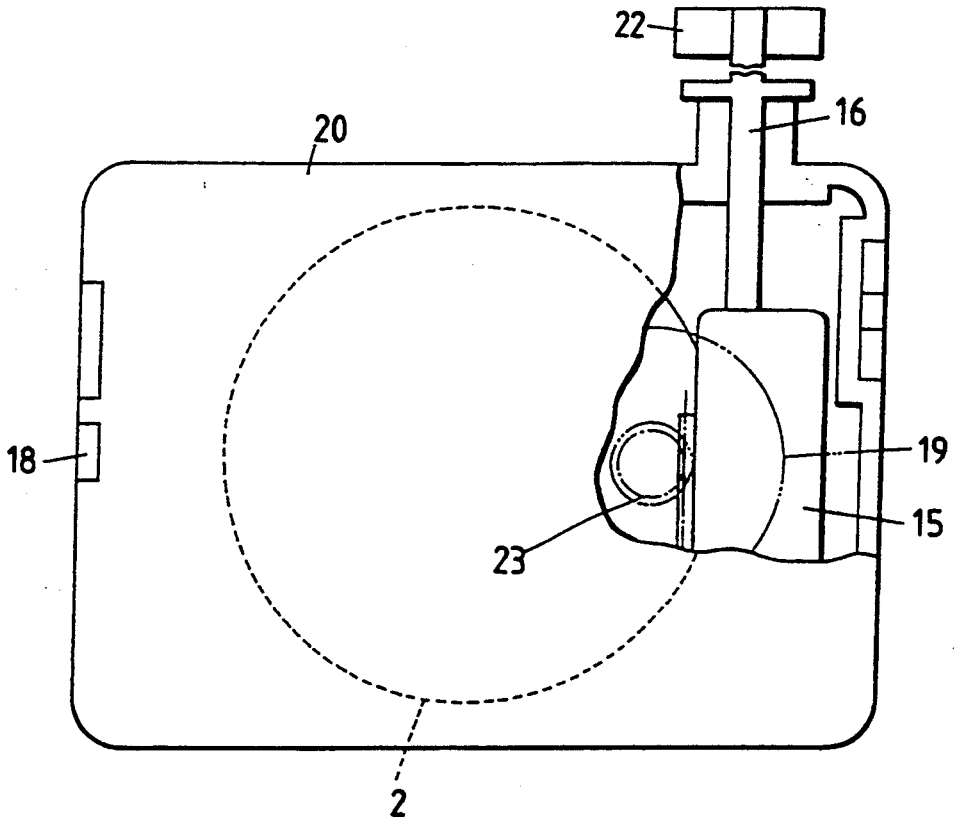
FIG. 3 is a partially cutaway front view of a motor, a reducing gear train, and a rack.
Figure 4:
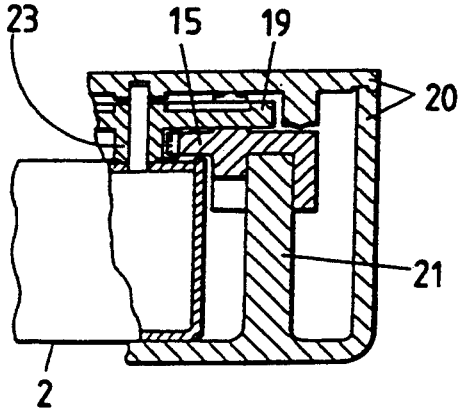
FIG. 4 is a sectional view of the reducing gear train and the rack.

As shown in FIGS. 1 and 2, the baffle 3 is inserted into the bearings 6 from sideways at two pivots 9 projecting sideways at a lower portion thereof, and is rotatably supported. A packing 10 is designed to abut on the cold air inlet 5 to close the cold air inlet 5.

The baffle 3 has a hollow portion 11 which is formed in a coupling portion 14 below the baffle 3 so as to be eccentric relative to the pivot 9. A elastic plate 12 is inserted into and fixed on a slit 13 formed in the hollow portion 11 by pressure. The hollow portion 11 has openings in the front and in the back that confronts the frame 4, and furthermore has an opening 17 on the lower side surface thereof to allow a projected portion 16 of a rack (described later) to be inserted.

Figure 5:
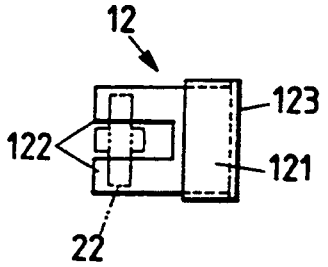
FIG. 5 is a plan view of an elastic plate.

As shown in FIG. 2, the elastic plate 12 is inverted C-shaped as viewed from the side surface. A bent strip 121 on the upper side is inserted into and fixed on the slit 13 by pressure, the slit 13 being on the upper side; and, as shown in FIG. 5, two elastic strips 122 on the lower side enter into the hollow portion 11 that is on the lower side and a back plate 123 abuts against the front surface of the coupling portion 14. With the elastic plate 12 having been inserted into the slit 13 by pressure, the front surface of the hollow portion 11 is closed. Further, as shown in FIGS. 2 and 5, the elastic strips 122 are attached so as to bias an engaging shaft 22 onto the coupling portion 14. That is, the elastic strips 122 abut on the coupling portion 14 at all times independently of the opening and closing positions of the baffle 3, so that no play is provided.

On the other hand, the motor 2 abuts against the front surface of the frame 4 and is secured to the frame 4 by engagement between the holding strips 8 and holding steps 18 formed outside a unit case 20. The rotation of the motor 2 inside the unit case 20 is reduced by a reduction gear train 19, and the reduced rotation is transmitted to the rack 15 that is meshed with the last-stage gear 23. The reduction gear train 19 is arranged by taking into account the opening and closing cycle of the baffle 3 and the opening and closing amount of the baffle 3 based on the rotation of the motor 2.

The rack 15 stretches over a guide 21 inside the unit case 20, and is accommodated so as to be able to reciprocate in the longitudinal direction of the guide 21. Further, one end of the rack 15 projects outside the unit case 20, so that the engaging shaft 22 projecting on both sides on the front end of the projected portion 16 is formed integrally therewith. With the motor 2 mounted at a predetermined position of the frame 4, the projected portion 16 of the rack 15 enters into the hollow portion 11 from the opening 17 and is interposed between the two elastic strips 122.

In such an assembly, the engaging shaft 22 abuts on the upper surface of the hollow portion 11 on the upper side as shown in FIG. 2, and is in contact with the two elastic strips 122 on the lower side as shown in FIG. 5. The two elastic strips 122 are elastically deformable inside the hollow portion 11. Since the hollow portion 11 is made larger in height than the engaging shaft 22 (FIGS. 1 and 2), the engaging shaft 22 has a play in the vertical direction inside the hollow portion 11. As described above, the engaging shaft 22 which is formed integrally with the rack 15 is arranged so as to be eccentric relative to the pivot 9 of the baffle 3, and is coupled by engagement with the coupling portion 14 of the baffle 3.

When the motor is rotated in a predetermined direction to elevate the rack 15, the engaging shaft 22 abuts against the upper surface of the hollow portion 11 to thereby turn the baffle 3 in the opening direction. As a result, the cold air inlet 5 is opened. When the motor is rotated in reverse, the engaging shaft 22 abuts against the elastic strips 122 of the elastic plate 12 on the lower side and presses them down. As a result, the baffle 3 is caused to move in the closing direction.

Further, a play is provided between the lower surface of the hollow portion 11 and the engaging shaft 22 to allow the rack 15 to overrun even after the cold air inlet 5 is completely closed with the packing 10 of the baffle 3 which is abutting against the rim of the cold air inlet 5. Therefore, even if the rack 15 receives a force large enough to close the baffle 3, these coupled portions will not be broken. When the baffle 3 is frozen, the engaging shaft 22 flexes the elastic strips 122 so that the lower surface of the hollow portion 11 is pressed down to thereby eliminate the frozen condition and rotate the baffle 3. Once the baffle 3 has rotated, the restoring force of the elastic plate 12 moves the baffle 3 to be closed.

While the engaging shaft 22 is located closer to the frame 4 and the pivot 9 is located distant from the frame 4 in the above-mentioned embodiment, the positional relationship between the pivot 9 and the engaging shaft 22 may be reversed. The motor 2 may include dc motors, brushless motors, stepping motors, and the like.

According to the present invention, the linear reciprocating movement of the rack directly causes a driving force for opening and closing the baffle. Therefore, even if the baffle is frozen and thereby locked, not only the baffle can be operated within the range of the torques of the motor, but also the torque can be improved by changing the frequency to be applied to the motor in order to overcome factors hampering the opening and closing operation, such as freezing of the baffle or the like. Furthermore, according to the present invention, the baffle opening and closing stroke is set as a linear reciprocating movement distance of the rack. Therefore, it is not necessary to increase the thickness of the cam in accordance with the opening and closing stroke of the baffle, thereby allowing the drive section to be downsized in terms of thickness. Furthermore, according to the present invention, a linear movement range of the rack widens. Therefore, the amount of opening the baffle can be made sufficiently large, thereby contributing to increasing streams of cold air.

What is claimed is:

1. A damper, for opening and closing a cold air inlet formed through a frame of a refrigerator, said damper comprising;

a baffle having a plate pivotally mounted by a pivot on the frame for opening and closing the cold air inlet;

a motor for driving said baffle;

a reduction gear train rotatably coupled with said motor and including a last-stage gear, for reducing rotation of said motor, and transmitting the reduced rotation of said motor to said baffle; and a rack meshing with said last-stage gear of said reduction gear train and engaged with said baffle at an eccentric position relative to said pivot of said baffle, the eccentric position being located between the frame on which said baffle is mounted and said pivot;

wherein said baffle receives reciprocation of said rack at said eccentric position relative to said pivot of said baffle, and pivots about said pivot of said baffle so as to open and close the cold air inlet.

2. A damper according to claim 1, wherein said rack includes an engaging shaft arranged at an end of said rack, and wherein said baffle includes a hollow portion arranged at the eccentric position and an elastic plate fixed at the eccentric position, said engaging shaft being inserted into said hollow portion of said baffle, with one side of said engaging shaft being abutted against a side wall of said hollow portion, and the other side of said engaging shaft being abutted against said elastic plate fixed at the eccentric position of said baffle.

3. A damper according to claim 1, wherein the eccentric position is formed closer to the frame than said pivot of said baffle.

* * * * *